US010561913B2

(12) United States Patent
Burger et al.

(10) Patent No.: US 10,561,913 B2
(45) Date of Patent: Feb. 18, 2020

(54) BAT END CAP ASSEMBLY

(71) Applicant: Wilson Sporting Goods Co., Chicago, IL (US)

(72) Inventors: George W. Burger, Rocklin, CA (US); Robert Lairmore, Oceanside, CA (US); James M. Earley, Roseville, CA (US); Adam G. Gray, Roseville, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 137 days.

(21) Appl. No.: 15/425,243

(22) Filed: Feb. 6, 2017

(65) Prior Publication Data

US 2018/0221735 A1 Aug. 9, 2018

(51) Int. Cl.
*A63B 59/50* (2015.01)

(52) U.S. Cl.
CPC ..... *A63B 59/50* (2015.10)

(58) Field of Classification Search
CPC ..... A63B 2102/18; A63B 49/10; A63B 59/50
USPC ..... 473/256, 297, 457, 463, 519, 549, 521, 473/231; D21/753, 725, 727
See application file for complete search history.

(56) References Cited

U.S. PATENT DOCUMENTS 558,320 A 4/1896 Solberg
1,026,990 A 5/1912 Matson
1,455,379 A * 5/1923 Allen ..... A63B 53/08 473/337
1,499,128 A 6/1924 Shroyer, Jr.
3,116,926 A 1/1964 Owen et al.
4,936,586 A * 6/1990 Van Raemdonck ... A63B 49/08 473/519
5,277,421 A 1/1994 Rewolinski
5,380,003 A 1/1995 Lanctot
5,456,461 A 10/1995 Sullivan
5,624,114 A 4/1997 Kelsey
5,674,138 A 10/1997 Nolan
6,280,353 B1 8/2001 Brundage
6,511,392 B1 1/2003 Chohan
6,569,042 B2 5/2003 LaChance et al.
6,682,447 B1 1/2004 Black
6,692,386 B2 2/2004 Brundage
6,869,373 B1 3/2005 Byrne et al.
6,875,137 B2 4/2005 Forsythe et al.
6,905,429 B2 6/2005 Forsythe et al.
7,014,580 B2 3/2006 Forsythe et al.
7,166,046 B1 1/2007 Liu
(Continued)

*Primary Examiner* — John E Simms, Jr.
*Assistant Examiner* — Rayshun K Peng
(74) *Attorney, Agent, or Firm* — Terence P. O'Brien; Todd A. Rathe

(57) ABSTRACT

An endcap assembly for a bat may include a body across an open end of a bat barrel and a core received by the body. In one implementation, the body and the core may be retained relative to one another by a bayonet connector radially spaced from interior sides of the bat barrel by at least 0.3 inch. In one implementation, the body may include a cup having a mouth and receiving the core. In one implementation, the cup is to be radially spaced from interior sides of the bat barrel by at least 0.3 inch. In one implementation, the mouth is axially recessed. In one implementation, the cup and the core are joined by a bayonet connector having a U-shaped slot facing away from a mouth of the cup.

24 Claims, 4 Drawing Sheets

(56) References Cited

U.S. PATENT DOCUMENTS

| | | | | |
|---|---|---|---|---|
| 7,198,581 | B1 | 4/2007 | Black | |
| 7,232,387 | B1 | 6/2007 | Heald et al. | |
| 7,311,620 | B1 | 12/2007 | Heald et al. | |
| 7,399,242 | B1 | 7/2008 | Smith | |
| 7,419,446 | B2 | 9/2008 | Nguyen | |
| 7,909,705 | B2 | 3/2011 | Gill et al. | |
| 7,914,404 | B2 | 3/2011 | Giannetti et al. | |
| 8,052,547 | B2 | 11/2011 | Nusbaum et al. | |
| 8,425,353 | B2 | 4/2013 | Jones et al. | |
| 8,632,428 | B2 | 1/2014 | Burger | |
| 2002/0094888 | A1 | 7/2002 | LaChance et al. | |
| 2003/0207720 | A1* | 11/2003 | Sery | A63B 53/02 473/256 |
| 2004/0043846 | A1* | 3/2004 | Haynes | A63B 60/42 473/564 |
| 2005/0176531 | A1 | 8/2005 | Fitzgerald et al. | |
| 2014/0080641 | A1 | 3/2014 | Epling et al. | |
| 2014/0080642 | A1 | 3/2014 | Epling et al. | |
| 2014/0342853 | A1 | 11/2014 | Thurman et al. | |
| 2014/0342854 | A1 | 11/2014 | Thurman et al. | |
| 2014/0342855 | A1 | 11/2014 | Thurman et al. | |
| 2014/0343898 | A1 | 11/2014 | Thurman et al. | |
| 2017/0100650 | A1* | 4/2017 | Anderle | A63B 59/56 |
| 2018/0015340 | A1* | 1/2018 | Codd | A63B 60/24 |

* cited by examiner

BAT END CAP ASSEMBLY

BACKGROUND

Baseball and softball are very popular sports in the United States, Japan, Cuba, and elsewhere. Many ball bats include an end cap, which can contain a prescribed amount of "casting" or dead weight to influence the balance point and the weight of the bat. The balance point and weight of the bat is often fixed and may not be ideal for every player.

DETAILED DESCRIPTION OF EXAMPLES

The present disclosure describes a baseball or softball bat that allows a player to adjust the balance point and weight of the bat according to his or her individual preferences. The present disclosure describes an endcap assembly for a baseball or softball bat that allows a batter to increase or decrease the weight of the endcap assembly. The endcap assembly is compact and easy to use. Moreover, the endcap assembly has weight adjusting components that enhance the durability of the bat as well as maintain or enhance the performance of the bat for an individual player.

Figure 1:
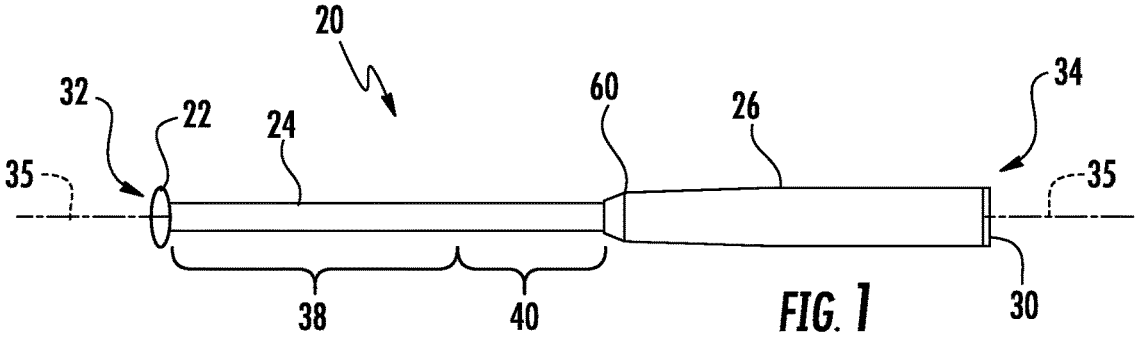
FIG. 1 is a side view of an example baseball or softball bat.
Figure 2:
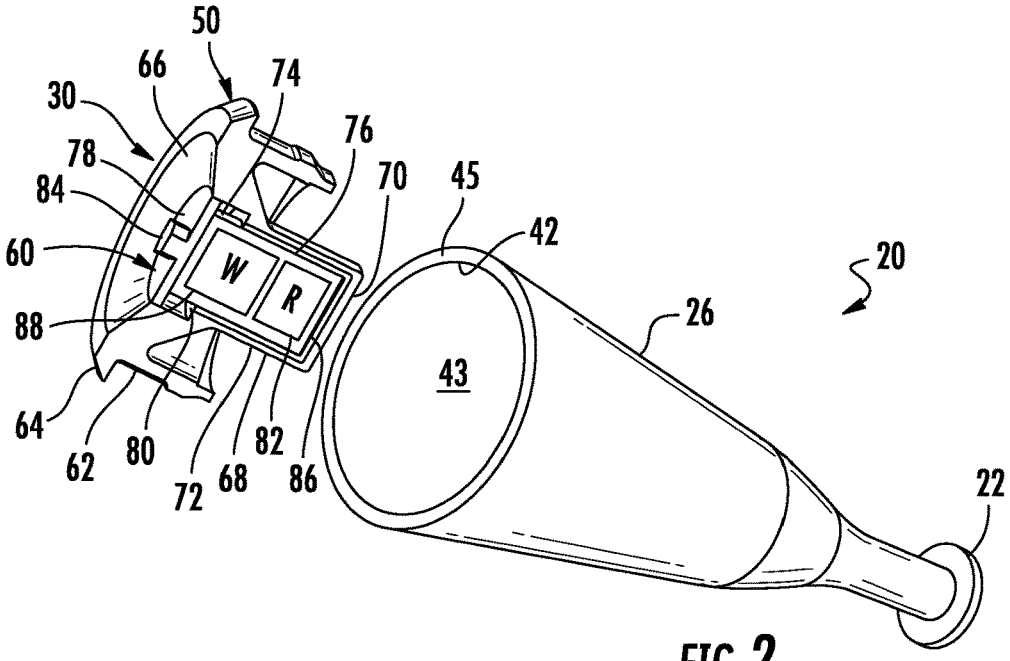
FIG. 2 is an exploded perspective view of the bat of FIG. 1 with portions schematically illustrated.

FIGS. 1 and 2 illustrate an example baseball or softball bat 20. FIG. 2 is an enlarged exploded perspective view of bat 20. As will be described hereafter, bat 20 includes an endcap assembly 30 that allows a batter to increase or decrease the weight of the endcap assembly 30 to adjust the weight and balance point of the bat 20. The endcap assembly 30 can be configured to be compact and easy to use. Moreover, as will be described hereafter, the endcap assembly has weight adjusting components that enable a player to adjust the weight, swing weight, balance and/or moment of inertia of the bat to meet his or her needs. Bat 20 comprises knob 22, handle 24, barrel 26, and endcap assembly 30.

Knob 22 is positioned at proximal end 32 of bat 20. Knob 22 extends from handle 24 and has a diameter wider than that of handle 24. In one implementation, knob 22 is attached to handle 24. In yet another implementation, knob 22 is integrally formed as a single unitary body with handle 24.

Handle 24 comprises elongate structure extending from knob 22 towards a distal end 34 of bat 20. Handle 24 has a proximal region 38 sized to be gripped by a batter's hands. Handle 24 has a distal region 40 connected to barrel 26. The handle 24 may have a substantially constant diameter along its length or have a diameter that varies along its length. In such an embodiment, an intermediate element or assembly can be used to couple the handle 24 to the barrel 26. In one implementation, the handle 24 can have a generally frusto-conical shape at its distal region 40 that can correspond to the barrel 26 to provide a mechanical lock with the barrel 26. The handle 24 is formed of a strong, generally flexible, lightweight material, preferably a fiber composite material. Alternatively, the handle 24 can be formed of other materials such as an aluminum alloy, a titanium alloy, steel, other alloys, a thermoplastic material, a thermoset material, wood or combinations thereof.

As used herein, the terms "composite material" or "fiber composite material" refer to a plurality of fibers impregnated (or permeated throughout) with a resin. In one preferred embodiment, the fibers can be systematically aligned through the use of one or more creels, and drawn through a die with a resin to produce a pultrusion, as discussed further below. In an alternative preferred embodiment, the fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In other implementations, more than 8 layers can be used. In yet other implementations, the layers may be thinner, wherein the number of layers ranges from 20 to 30 layers, nominally 25 layers. In multiple layer constructions, the fibers can be aligned in different directions (or angles) with respect to the longitudinal axis 35 including 0 degrees, 90 degrees and angular positions between 0 to 90 degrees, and/or in braids or weaves from layer to layer. For composite materials formed in a pultrusion process, the angles can range from 0 to 90 degrees. In some implementations, the layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon, thermoplastic, rubber, rubberized materials, and combinations thereof. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, aramid, Spectra®, poly-para-phenylene-2,6-benzobisoxazole (PBO), hemp and combinations thereof. In one set of preferred embodiments, the resin is preferably a thermosetting resin such as epoxy or polyester resins.

Barrel 26 comprises an elongate hollow tubular member which provides a hitting zone or surface for bat 20. The barrel 26 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. Alternatively, other hollow, tubular shapes can also be used. The barrel 26 is configured for impacting a ball (not shown), and preferably is formed of a strong, durable and resilient material, such as, an aluminum alloy. In alternative example embodiments, the proximal member 36 can be formed of one or more composite materials, a titanium alloy, a scandium alloy, steel, other alloys, a thermoplastic material, a thermoset material, wood or combinations thereof.

For example purposes only, one example composite barrel 26 may be manufactured by rolling layers of high aspect ratio parallelogram-shaped pieces of pre-preg, each layer having a height of about 0.005 inches (0.127 mm), on a rolling mandrel with the fibers oriented longitudinally, thereby making a tube with an outer diameter appropriately sized for a ball bat barrel. The parallelograms are rolled up such that each layer has a butt joint with itself and such that on one end all the layers stop at the same longitudinal station but on the other end, each layer is about one centimeter shorter than the previous layer, creating a tapered end 16. In one embodiment, the layers are angled +/−37 degrees from the longitudinal with each layer orientated at a negative angle to the previous layer.

A finishing mandrel includes a constant diameter section and a tapered section. After being rolled up, the barrel 26 is transferred to the constant diameter section of the finishing mandrel. The proximal region 36 is then slowly drawn down the tapered section of the finishing mandrel. The latex banding is then removed and ribbons of pre-preg about 0.5 inches (1.27 cm) wide are wound around the lay-up directly above the socket assembly 26, forming a thickness of about 20 layers of pre-preg, each layer having a height of about 0.005 inches (0.127 mm).

The barrel 26 is removed from the finishing mandrel and a portion of the handle 24 is inserted. The barrel 26 and handle 24 are capable of moving relative to each other about the pivot joints 40, 50, which dampens shock and vibration.

As shown by FIG. 2, barrel 26 has an axial end opening 42 sized and shaped to receive endcap assembly 30. Endcap assembly 30 (shown in section FIG. 2) closes or caps end opening 42 of barrel 26. In the example illustrated, endcap assembly 30 is symmetrically configured with respect to or about its axial centerline or the longitudinal axis 35. Endcap assembly 30 provides a player with the ability to adjust the balance point, moment of inertia, swing weight and/or weight of bat 20 by facilitating the adjustment of the weight of endcap assembly 30.

Endcap assembly 30 comprises body 50, and core 60. Body 50 comprises a structure configured to be mounted within opening 42 of barrel 26 so as to occlude or close opening 42. Body 50 comprises barrel retainer 62, rim 64, cover portion 66 and cup 68. Retainer 62 comprise structures that engage barrel 26 to retain body 30 within opening 42. In the example illustrated, barrel retainer 62 comprise a cylinder configured to be press-fit within opening 42, engaging the interior side surfaces of barrel 26. In the example illustrated, barrel retainer 62 comprise circumferential ribs that frictionally contact and engage the interior side surfaces 43 of barrel 26. In some implementations, barrel retainer 62 may be bonded, fused or welded to the interior sides of the barrel 26. In some implementations, barrel retainers 62 may snap into corresponding detents or projections formed along the interior side surfaces 43 of barrel 26.

Rim 64 radially projects outwardly from the retainer 62. Rim 64 is configured to extend across an axial edge or end 45 of barrel 26. Rim 64 protects the axial end of barrel 26.

Cover portion 66 extends radially inwardly from rim 64 and from barrel retainer 62 to cup 68. Cover portion 66 supports cup 68 while closing or covering the space between cup 68 and rim 64. In the example illustrated, cover portion 66 has a conical shape. The cover portion 66 can axially recess the cup 68 and the core 60 from the axial end of bat 20 and from rim 64. As a result, core 60 is less likely to be inadvertently bumped and inadvertently disconnected dislodged. In addition, core 60 is likely to be bumped or contacted and potentially damaged, such as when bat 20 is stood up against a wall or fence on the ground with rim 64 abutting the ground.

In one implementation, cover portion 66 recesses the top of core 60 from rim 64 and the axial end of bat 20 by an axial distance of at least 0.1 inch. In other implementations, the recess provided by cover portion 66 may have other depths. Although cover portion 66 is illustrated as being conical in shape, in other implementations, cover portion 66 may have other shapes and configurations providing the noted recess. For example, in other implementations, cover portion 66 may comprise multiple interconnected tapered or inclined panels extending from rim 64 radially inward to cup 68. In lieu of comprising a smooth gradual ramp or slope from rim 64 to cup 68, cover portion 66 may comprise multiple rings between rim 64 and cup 68 with each of the rings having a different slope. In yet other implementations, cover portion 66 may comprise one or more intermediate steps between rim 64 and cup 68. In still other implementations, cover portion 66 may comprise a floor surface extending perpendicular to the axial centerline of bat 20, wherein the floor surface is axially recessed from rim 64 and is connected to rim 64 by a wall that extends between the floor surface and the rim 64, either sloping or extending parallel to the axial centerline of bat 20.

Cup 68 comprises a core receiving container axially extending from cover portion 66 towards knob 22 of bat 20. Cup 68 comprises a floor 70, outer walls 72 and a mouth 74. Outer walls 72 extend from floor 70 in a direction away from knob 22, terminating at mouth 74. Mouth 74 faces in a first direction away from knob 22. Floor 70 and outer walls 72 of cup 68 define interior cavity 76 configured to receive core 60. Outer walls 72 extend about axis 35 of bat 20 and have exterior surfaces radially spaced from the interior sides 43 of barrel 26 by a radial spacing of at least_0.3 inch. Because outer walls 72 and cup 68 are radially spaced inwardly from the interior sides 43 of barrel 26, body 30 has a reduced stiffness as compared to a cup having a greater diameter or extending across a greater portion of opening 42. The reduced stiffness of body 30 provides bat 20 with a lower stiffness at its axial end, enhancing hitting performance of bat 20. In one implementation, the outer walls 72 are radially spaced apart from the interior sides 43 of the barrel 26 by a radial spacing within the range of 0.3 to 1.0 inch. In another implementation, the radial spacing is within the range of 0.4 to 0.6 inch. In another implementation, the radial spacing is within the range of 0.6 to 0.8 inch. In another implementation, the radial spacing is within the range of 0.7 to 0.9 inch. In another implementation, the radial spacing is within the range of 0.5 to 0.7 inch. In another implementation, the radial spacing is within the range of 0.8 to 1.0 inch. In other implementations, the radial spacing may have other dimensions.

Core 60 comprises a weight or weight receiving component releasably or removably mounted within cup 68. For purposes of this disclosure, the term "releasably" or "removably" with respect to an attachment or coupling of two structures means that the two structures may be repeatedly connected and disconnected to and from one another without material damage to either of the two structures or their functioning. Core 60 comprises a top 78, sidewalls 80 and retainer 82 (schematically shown).

Top 78 extends across mouth 74 of cup 68, closing mouth 74. In the example illustrated, top 78 comprises a polygon a knob 82 that facilitates manual or tool-less gripping of core 60 and rotation of core 60 relative to cup 68. In other implementations, knob 84 may have other configurations. For example, in other implementations, knob 84 may be configured to be engaged by a tool. In some implementations, top 78 may alternatively comprise a detent or cavity for receiving the end of the tool to facilitate turning of core 60 relative to cup 68. In still other implementations, top 78 may comprise other mechanisms to facilitate manual gripping and movement of core 60.

Sidewalls 80 axially extend from top 78 towards knob 22 and towards floor 70 of cup 68. Sidewalls 80 form a hollow cylinder or sleeve extending about the centerline of core 60 and cup 68, terminating at a mouth 86 that faces floor 70 and knob 22 in an axial direction opposite to the direction in which mouth 74 faces. Sidewalls 80 and top 78 form an interior cavity 87 for containing at least one weight 88 (schematically shown). Top 78 and floor 70 cooperate to form an enclosed volume for containing the at least one weight 88. In other implementations, core 60 may include a bottom floor that closes mouth 86.

Retainer 82 (schematically illustrated) comprises a structure carried by core 60 that assists in axially securing core 60 in place relative to cup 86, inhibiting inadvertent withdrawal of core 60 from cup 68. In one implementation, retainer 82 comprises a set of threads formed on the exterior surfaces of sidewalls 80 which threadably engage interior threads provided on the inner surface of sidewalls 72 of cup 68. In such an implementation, core 60 is screwed into cup 68, releasably securing core 60 in place within cup 68. In another implementation, retainer 82 may comprise a bayonet connector portion that interlocks with a corresponding bayonet connector portion provided in the interior of cup 68. In still other implementations, retainer 82 may comprise other snaps, hooks, clips or other mechanisms that facilitate releasable connection and retention of core 60 within cup 68.

Figure 3:
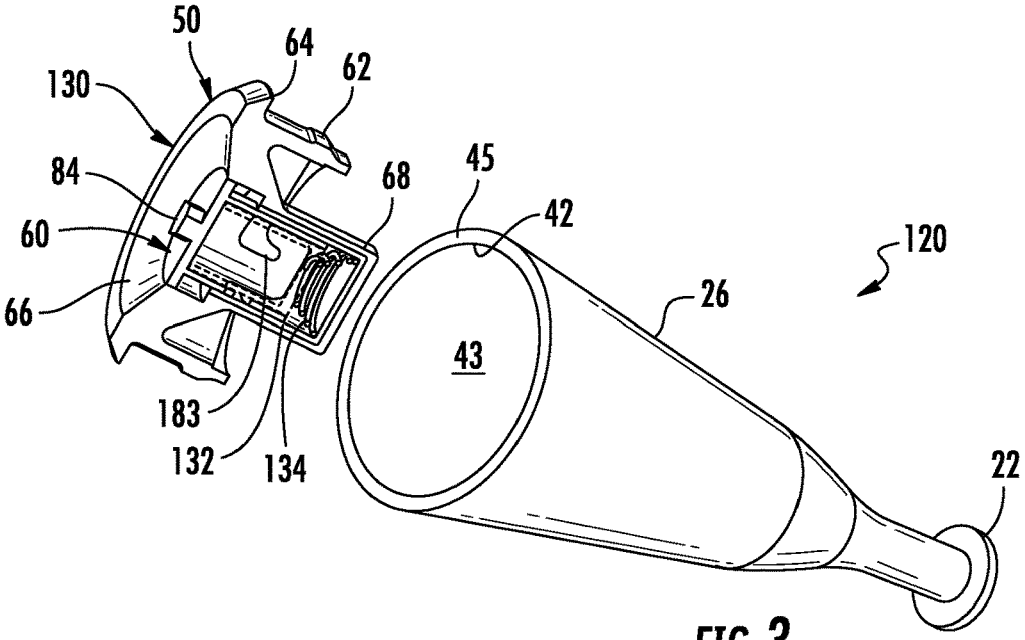
FIG. 3 is an exploded perspective view of another example of the bat of FIG. 1 with portions schematically illustrated.

FIG. 3 is an exploded perspective view of bat 120, an example implementation of bat 20. Bat 120 is similar to bat 20 described above except that bat 120 is specifically illustrated as comprising endcap assembly 130 (shown in section), an example implementation of endcap assembly 30. Those remaining components of bat 120 which correspond to bat 20 are numbered similarly.

Figure 4:
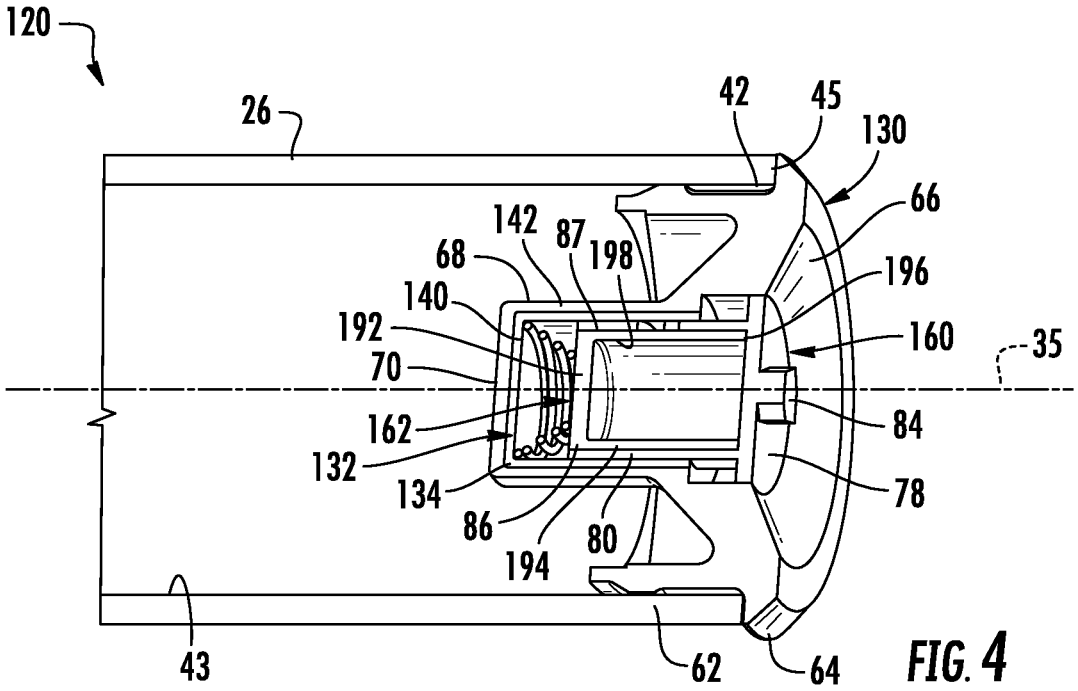
FIG. 4 is a sectional view of a portion of the bat of FIG. 3.
Figure 5:
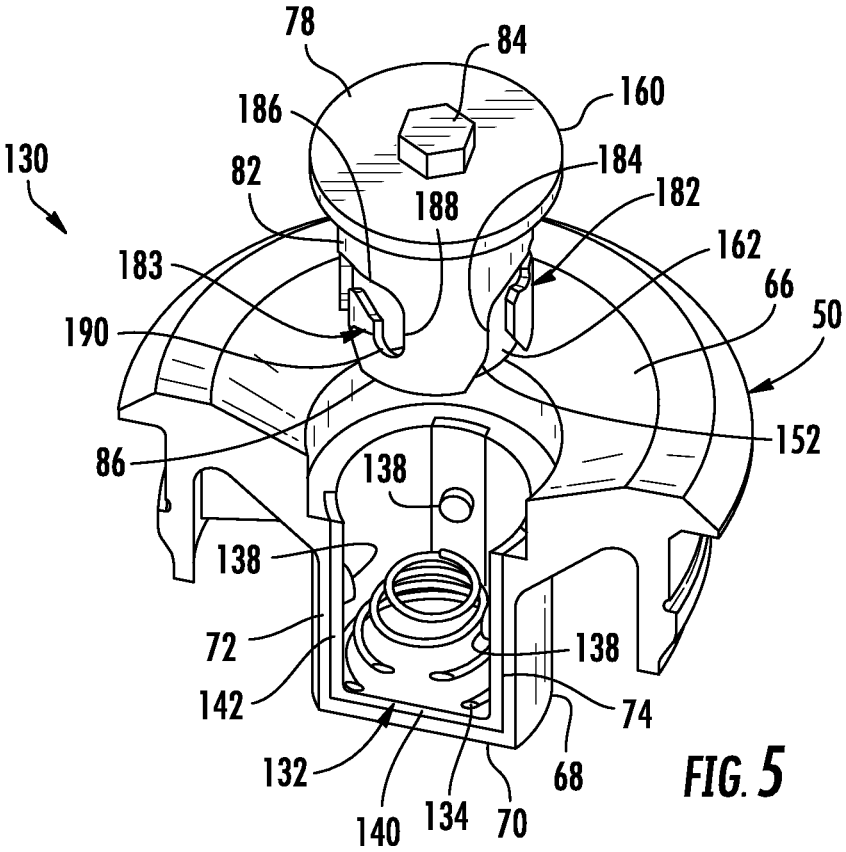
FIG. 5 is an exploded perspective view of an example end cap assembly of the bat of FIG. 3 with portions shown in section.

FIGS. 4 and 5 illustrate end cap assembly 130 in more detail. Endcap assembly 130 is similar to endcap assembly 30 except that endcap assembly 130 additionally comprises insert 132 and spring 134. Endcap assembly 130 further comprises core 160, an example implementation of core 60. Those remaining components of endcap assembly 130 which correspond to components of endcap assembly 30 are numbered similarly.

Insert 132 comprises a structure that is mounted within or co-molded as part of body 50 along and within the interior of cup 68. Insert 132 provides at least one projection 138 that cooperates with a bayonet connector portion (described hereafter) of core 160 to axially retain secure core 160 within cup 68. In the example illustrated, insert 132 comprises a disk 140 from which three symmetrically spaced fingers 142 (one completely and two are partially shown) axially project. Disc 140 serves as a floor for supporting fingers 142. In the example illustrated, disc 140 cooperates with fingers 142 to support and contain spring 134 such that spring 134 may be assembled with insert 132 prior to insertion of insert 132 and spring 134 into cup 68. Fingers 142 support projections 138. In the example illustrated, fingers 142 are recessed into outer wall 72 of cup 68 so as to have interior faces flush with the interior side surfaces of cup 68, neither reducing the diameter of cavity 74 nor necessitating an increase in the diameter of cup 68 to receive core 160, where such an increase in the diameter of cup 68 might otherwise increase the stiffness of endcap assembly 130.

Although insert 134 is illustrated as having three fingers 142 and three projections 138, in other implementations, insert 132 may alternatively comprise a greater or fewer number of such fingers 142 and projections 138. In yet other implementations, endcap assembly 130 may omit insert 134 where projections 138 are secured sidewalls 72 or are integrally formed as part of a single unitary body with sidewalls 72 along the interior cavity 74 of cup 68. For example, in one implementation, projection 138 may be molded along with the molding of body 50 and cup 68.

Spring 134 is supported within the bottom of cup 68 and is configured to resiliently urge core 160 in an axial direction away from knob 22, towards mouth 74 of cup 68. In the example illustrated, spring 134 comprises a compression spring supported within insert 132 and coupled to core 160 by weight plug 162, wherein spring 134 applies a force to weight plug 162 which transfers a force to core 160. In other implementations, spring 134 may comprise other types of springs, such as a leaf spring. In other implementations, spring 134 may rest directly upon floor 70 of cup 68 or may be carried and supported by weight plug 162 of core 160. In some implementations, spring 134 may be integrally formed as a single unitary body as part of disc 140 of insert 132 or as part of floor 70 of cup 68. For example, spring 134 may be molded as part of disc 140 of insert 132 (where insert 132 is utilized) or as part of floor 70 of cup 68 (where insert 132 is not utilized, but wherein projections 138 are provided directly upon the interior surfaces of cup 68). In some implementations, spring 134 may be omitted.

Core 160 is similar to core 60 described above except that core 160 is specifically illustrated as comprising retainer 182, an example implementation of retainer 82. Retainer 182 comprises a bayonet connector portion that cooperates with projections 138 (serving as another bayonet connector portion) to axially secure and releasably retain core 160 within cup 68. As shown by FIG. 4, retainer 182 comprises a U-shaped slot 183 for each of the projections 138. Each slot 183 is sized to slidably receive its corresponding projection 138. Each slot 183 has an inlet opening 152 along mouth 86 of core 160 and facing away from top 78 of core 160. Each slot 183 further comprises a first axial portion 184 extending away from inlet opening 152 in an axial direction towards top 78, a second portion 186 extending in a circumferential direction and a third portion 188 axially extending from portion 156 towards mouth 86, terminating at a blind or closed end 190.

Each slot 183 extends into sidewalls 182 of core 160. In the example illustrated, each slot 183 extends completely through sidewalls 182 of core 160. In other implementations, each slot 183 may alternatively comprise a groove or channel, only partially projecting through the thickness of walls 182 of core 160. Although core 16 is illustrated as having three slots 183, corresponding to the three projections 138, in other implementations, core 160 may comprise a greater or fewer of such slots 183 when a greater or fewer of such projections 138 is correspondingly provided within cup 68. In some implementations, slots 183 may alternatively be formed within the interior sides of outer walls 72 or insert 132, wherein projections 138, corresponding to slots 183, are alternatively provided along the exterior of walls 82 of core 160.

Weight plug 162 comprises a cup-shaped member removably received within the interior cavity 87 of core 160. In the example illustrated, weight plug 162 comprises a floor 192 and sidewalls 194 that a project from floor 192 and terminate at a mouth 196. Mouth 196 faces top 78 of core 160. In one implementation, bat 120 may comprise a plurality of interchangeable different weight assemblies 130, wherein each of the different weight assemblies 130 are similar in all respects but for the inclusion of different weight plugs 162 having different weights. In one implementation, the different weight plugs 162 may have the same outer and inner dimensions, the same diameter, the same wall thickness and the same height, but wherein the different weight plugs are formed from different materials or combinations of materials so as to have different masses and/or weights. In another implementation, the different weight plugs may have the same outer dimensions, but different inner dimensions to provide different weights. For example, the thickness of floor 192 and/or the thickness of walls 194 may be varied amongst the different weight plugs 162 to provide the different weight plugs 162 with different weights. In some implementations, some of the different weight plugs may have the same overall weight, but wherein the different weight plugs have different centers of mass due to the dimensioning of the different weight plugs or the selective use of different materials for different portions of the different weight plugs. In one implementation, the weight plug 162 can be a solid, non-hollow continuous mass. In one implementation, the weight plug 162 can be at least two weight plugs with one plug having a greater axial length than the other.

In one implementation, additional mass or additional supplemental weight may be provided, through mouth 196, into the interior cavity 198 of weight plug 162, prior to insertion of weight plug 162 into interior cavity 194 of core 160 and prior to insertion of core 160 into cup 68. In such an implementation, top 78 closes off mouth 196 to retain the supplemental weight within interior cavity 198 of weight plug 162. In yet other implementations, weight plug 162 may lack cavity 198 or cavity 198 may be permanently filled.

Figure 6:
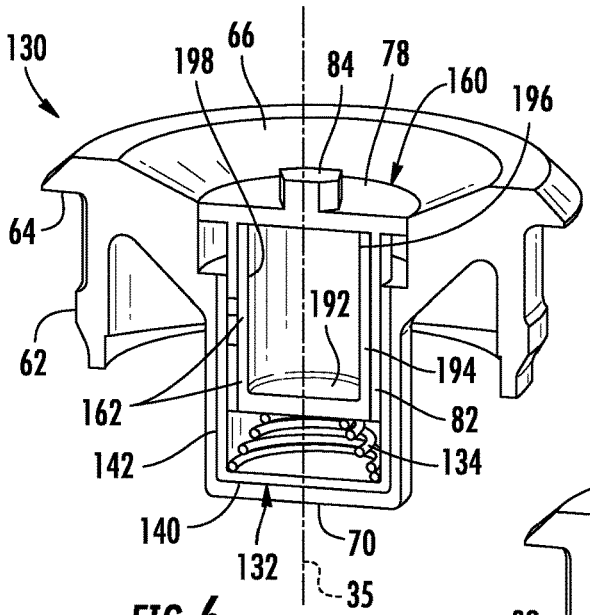
FIG. 6 is a sectional view of the end cap assembly of FIG. 4 in a locked state.
Figure 7:
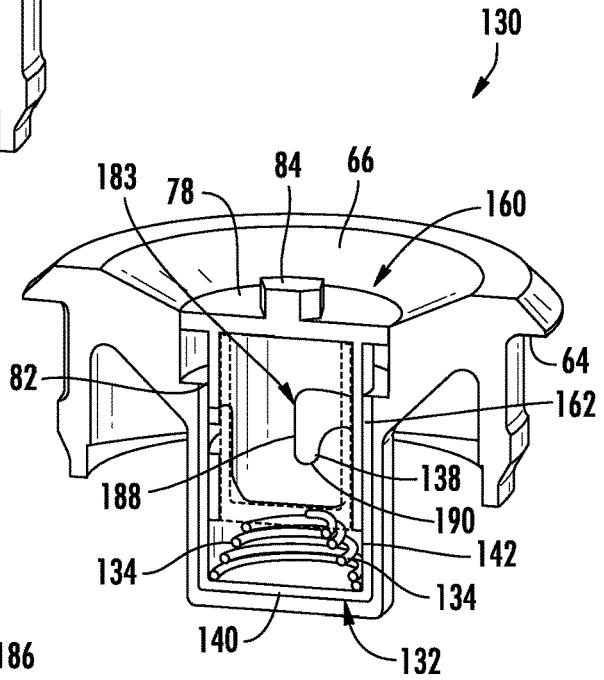
FIG. 7 is a sectional view of the end cap assembly of FIG. 4 in the locked state with portions transparently illustrated.

FIGS. 6-9 illustrate use of end cap assembly 130. FIGS. 6 and 7 illustrate end cap assembly 130 in a locked state. FIG. 7 transparently illustrates weight plug 162 to illustrate the interaction of one of projections 138 with its corresponding slot 183. As shown by FIGS. 6 and 7, when end cap assembly 130 is in the locked state, spring 134 is resiliently urging weight plug 162 and core 160 in an axial direction away from floor 70 of cup 68. This results in projection 138 being retained within portion 188 of slot 183, urged against and in contact with end 190. As a result, core 160 and weight plug 162 cannot be inadvertently withdrawn from cup 68. In addition, core 160 cannot be rotated relative to cup 68.

Figure 8:
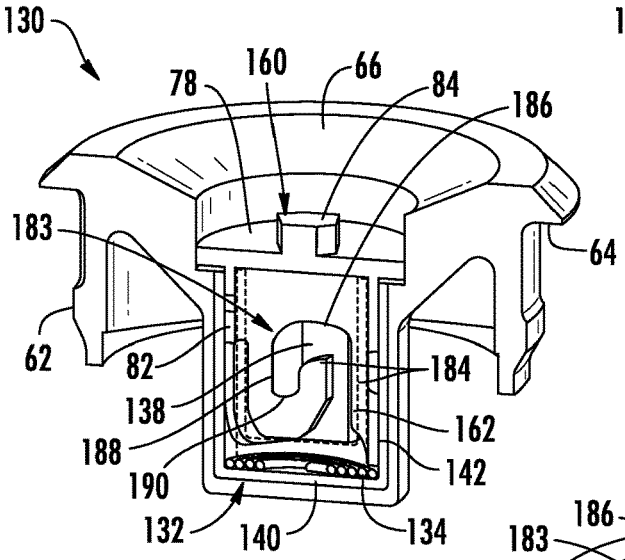
FIG. 8 is a sectional view of the example end cap assembly of FIG. 4 in a semi-locked state.
Figure 9:
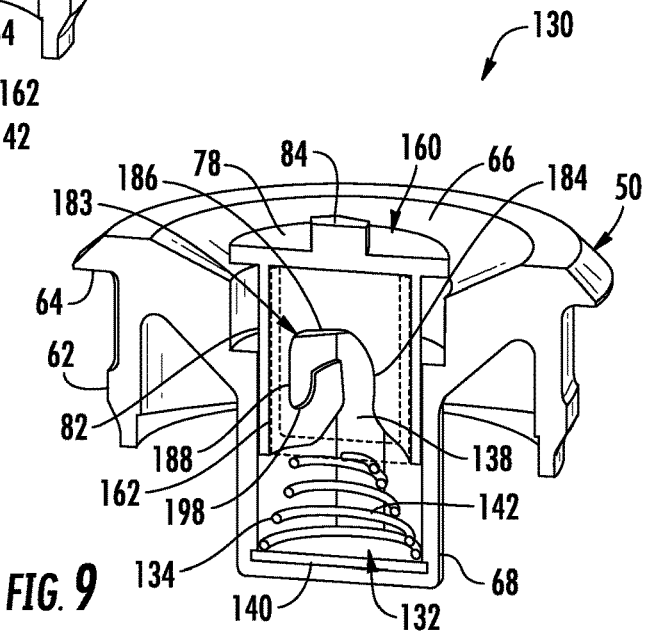
FIG. 9 is a sectional view of the example end cap assembly of FIG. 4 in a released or unlocked state.

FIG. 8 illustrates end cap assembly 130 in a semi-locked state, a state that occurs when a player is moving core 160 and weight plug 162 from the locked state shown in FIGS. 6 and 7, to the unlocked state shown in FIG. 9 by concurrently axially depressing core 160 and rotating core 160. Depressment of core 160 by a player against the bias of spring 134 moves slot 183 to locate projection 138 out of engagement with and 190 and at a junction of portions 188 and 186 of slot 183. Rotation of core 160 rotates slot 183 relative to projection 138 such that projection 138 is circumferentially moved within and across portion 186 of slot 183 to a junction of portion 186 and portion 184 of slot 183.

FIG. 9 illustrates end cap assembly in an unlocked state. Once core 160 has been sufficiently rotated to locate projection 138 at the intersection of portion 186 and portion 184 of slot 183, spring 134 axially urges core 160 in a direction away from floor 70 of cup 68. This results in projection 138 being located in portion 184 of slot 183, where core 160 and weight plug 162 may be axially withdrawn completely from cup 68 of body 50 to facilitate replacement of weight plug 162 with a different weight plug 162 having a different center of mass or a different overall weight or to facilitate replacement of the existing core 160 with a different core 160 having a different center of mass or different overall weight due to either a different received weight plug 162 or a material composition of the different core 160. To reinsert the core 160 with a different weight plug 162 or to insert a different similar shaped core 160 having the same or a different weight plug 162 may be achieved by performing the above operations in the reverse order.

Figure 10:
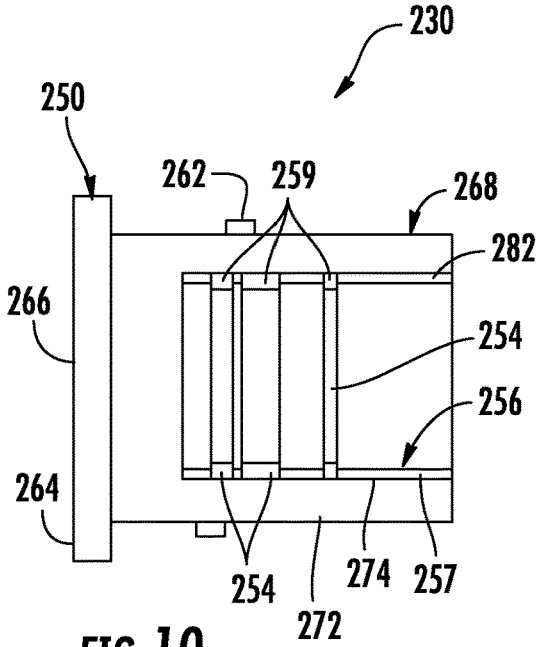
FIG. 10 is a sectional view of an example end cap assembly for use in the bat of FIGS. 1 and 2.

FIG. 10 is a sectional view schematically illustrating end cap assembly 230 for use as part of bat 20 or bat 120, in place of end cap assembly 30 or end cap assembly 130. End cap assembly 230 comprises body 250, weights 254 and retainer 256. Body 250 comprises a structure configured to be mounted within opening 42 of barrel 26 (shown in FIGS. 1 and 2) so as to occlude or close opening 42. Body 250 comprises barrel retainers 262, rim 264, cover portion 266 and cup 268. Retainers 262 comprise structures that engage barrel 226 to retain body 50 within opening 42. In the example illustrated, barrel retainer 262 comprises a cylinder configured to be press-fit within opening 42, engaging the interior side surfaces of barrel 26. In the example illustrated, barrel retainers 262 comprise circumferential ribs that frictionally contact and engage the interior side surfaces 43 of barrel 26. In some implementations, barrel retainer 62 may be bonded, fused or welded to the interior sides of the barrel 26. In some implementations, barrel retainers 262 may snap into corresponding detents or projections formed along the interior side surfaces 43 of barrel 26.

Rim 264 radially project outwardly from the retainer 262. Rim 264 is configured to extend across an axial edge or end 45 of barrel 26 (shown in FIG. 2). Rim 264 protects the axial end of barrel 26.

Cover portion 266 extend radially inwardly from rim 264 and from barrel retainer 262 to cup 268. Cup 268 extends from rim 264 and cover portion 266. Cup 268 comprises side walls 272 which extend from cover portion 266 and which terminate at mouth 282 which faces away from cover portion 266. Sidewalls 272 and cover portion 266 form an interior cavity 274 which removably receives weights 254.

Weights 254 comprise objects or structures having a mass and which are removably received within cavity 274. In the example illustrated, each of weights 254 has a different weight, allowing weights 254 to be added or removed to incrementally adjust the overall weight of end cap assembly 250. In the example illustrated, each of weights 254 has the general shape of a chip or disc which are supported in parallel within cavity 274. In one implementation, weights 254 comprise discs formed from a metal. In another implementation, weights 254 comprise discs having a rubber or polymer exterior layer encapsulating an internal metal core. In yet other implementations, weights 254 may have other configurations.

Retainer 256 comprises a structure provided on the inner surface of walls 272 which axially retains weights 254 in place within cavity 274. In one implementation, retainer 282 comprises a layer 257 of a resiliently compressible material, such as a rubber or foam, formed along the inner surface of cavity 274, wherein the layer resiliently compresses or deforms to extend around the edge and opposite faces of a weight 254 so as to grip the weight and to hold weights 254 in place. In yet another implementation, retainer 282 may additionally or alternatively comprise a layer 259 of a resiliently compressible material, such as a rubber or foam, formed along the outer edge of each of weights 254, wherein the layer resiliently compresses or so as to grip the inner sides of cavity 274.

In yet another implementation, retainer 254 comprises internal threads (257, schematically illustrated) formed on the interior surface of wall 272, wherein the outer perimeter edge of each of weights 254 includes external threads such that weights 254 may be threaded into cavity 274 to desired axial positions within cavity 274. Such weights 254 may be removed, added or exchanged to alter the overall weight of end cap assembly 230. In addition, the axle positioning of weights 254 may be adjusted to alter the center of mass of end cap assembly 230 to thereby adjust the balance point of the bat in which assembly 230 is mounted.

Figure 11:
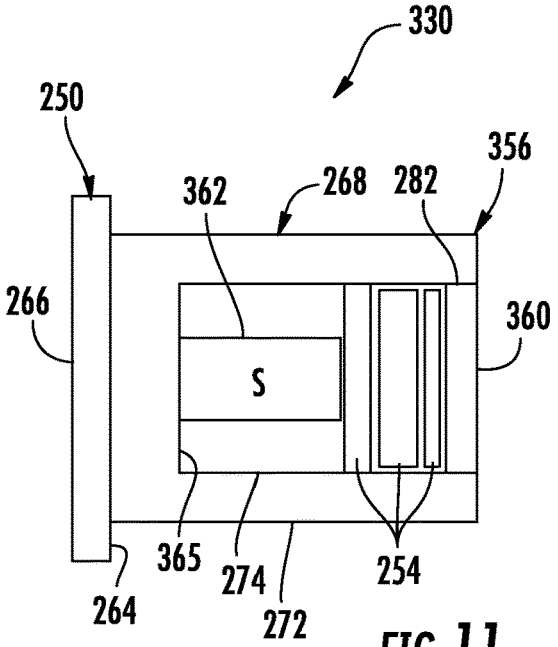
FIG. 11 is a sectional view of an example end cap assembly for use in the bat of FIGS. 1 and 2.

FIG. 11 is a sectional view schematically illustrating end cap assembly 330, another example implementation of end cap assembly 230. End cap assembly 330 is similar to end cap assembly 230 except that end cap assembly 330 comprises retainer 356 in lieu of retainer 256. Those remaining components of end cap assembly 330 which correspond to components of end cap assembly 230 are numbered similarly.

Retainer 356 retains weights 254 within cavity 274. Retainer 356 comprises cover 360 and spring 362. Cover 360 comprises a cap that releasably mounts to sidewalls 272 and that extends across mouth 282 so as to close cavity 274 and retain weights 254 therewithin. In one implementation, cover 360 has external threads which threadably engaging internal threads along the inner surfaces of sidewalls 272, allowing cover 360 to be screwed into place. In other implementations, cover 360 may snap onto cup 268, may latch onto cup 268 or may be secured to cup 268 across mouth 282 in other fashions.

Spring 362 comprise a compression spring captured between weights 254, which are arranged in a face-to-face stack, and the floor 365 of cup 268. Spring 362 resiliently urges weights 254 against one another and against cover 360. Although illustrated as a compression spring, in other implementations, spring 360 may alternatively comprise at least one leaf spring. In some implementations, spring 362 may be omitted, such as where cover 360 is configured to be screwed a sufficient distance into cavity 274 so as to press and retain weights 254 against floor 365 and inhibit axial movement or repositioning of weights 254.

Figure 12:
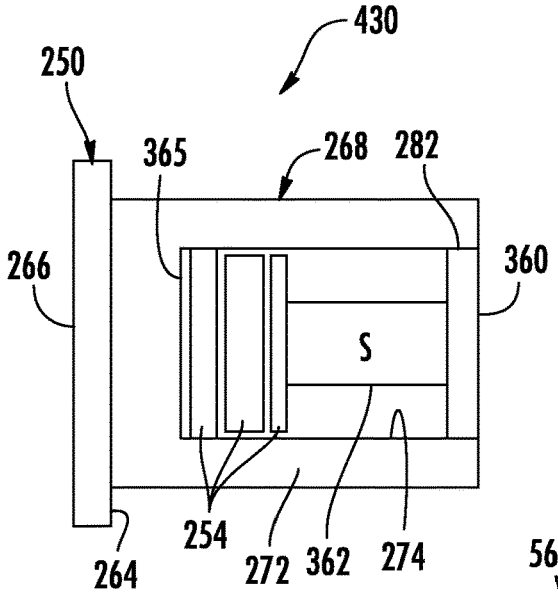
FIG. 12 is a sectional view of an example end cap assembly for use in the bat of FIGS. 1 and 2.

FIG. 12 is a sectional view schematically illustrating end cap assembly 430, another implementation of end cap assembly 330. End cap assembly 430 is similar to end cap assembly 330 except that spring 362 is captured between cover 360 and the stack of weights 254, pressing the stack weights 254 against floor 365. Those components of end cap assembly 430 which correspond to components of end cap assembly 330 are numbered similarly.

Figure 13:
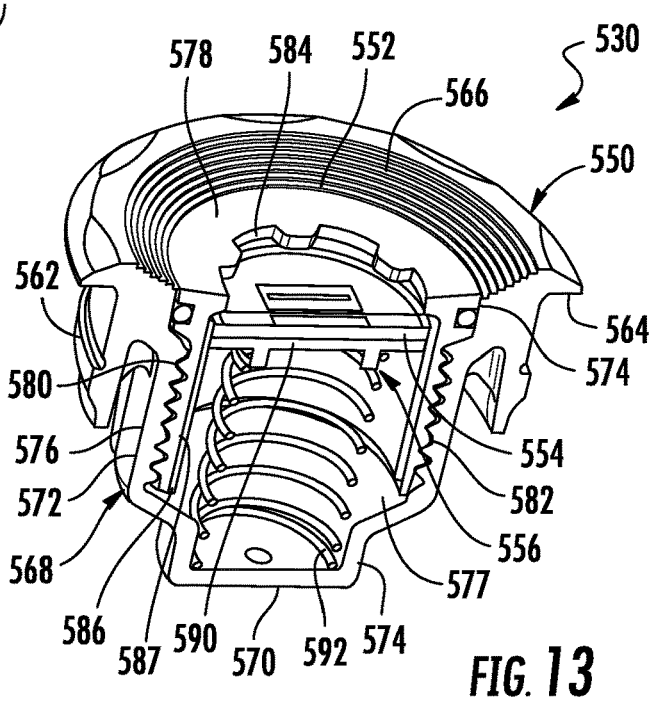
FIG. 13 is sectional view of an example end cap assembly for use in the bat of FIGS. 1 and 2.

FIG. 13 is a sectional view illustrating end cap assembly 530, an example implementation of end cap assembly 30. End cap assembly 530 comprises body 550, core 552, weights 554 and weight retainer 556. Body 550 comprises a structure configured to be mounted within opening 42 of barrel 26 so as to occlude or close opening 42. Body 550 comprises barrel retainers 562, rim 564 cover portion 566 and cup 568. Retainer 562 comprises structures that engage barrel 26 to retain body 30 within opening 42. In the example illustrated, barrel retainer 562 comprises a cylinder FIG. 2B press-fit within opening 42 engaging the interior side surfaces of barrel 26. In the example illustrated, barrel retainers 62 comprise circumferential ribs that frictionally contact and engage the interior side surfaces 43 of barrel 26. In some implementations, barrel retainer 562 may be bonded, fused or welded to the interior sides of the barrel 26. In some implementations, barrel retainer 562 may snap into corresponding detents or projections formed along the interior side surfaces 43 of barrel 26.

Rim 564 radially project outwardly from the retainer 562. Rim 564 is configured to extend across an axial edge or end 45 of barrel 26. Rim 564 protects the axial end of barrel 26.

Cover portion 566 extend radially inwardly from rim 564 and from barrel retainer 562 to cup 568. Cover portion 66 supports cup 568 while closing or covering the space between cup 68 and rim 64. In the example illustrated, cover portion 566 has a conical shape, axially recessing cup 568 and core 552 from the axial end of bat 20 and from rim 564. As a result, core 552 is less likely to be inadvertently bumped and inadvertently disconnected dislodged. In addition, core 552 is likely to be bumped or contacted and potentially damaged, such as when bat 20 is stood up against a wall or fence on the ground with rim 564 abutting the ground.

In one implementation, cover portion 66 recesses the top of core 552 from rim 564 and the axial end of bat 20 by an axial distance of at least 0.25 inch for a barrel having an outer diameter of 2.25 inches. In other implementations, the recess provided by cover portion 566 may have other depths. Although cover portion 566 is illustrated as being conical in shape, in other implementations, cover portion 566 may have other shapes and configurations of providing the noted recess. For example, in other implementations, cover portion 566 may comprise multiple interconnected tapered or inclined panels extending from rim 564 radially inward to cup 568. In lieu of comprising a 5 gradual ramp or slope from rim 564 to cup 568, cover portion 566 may comprise multiple rings between rim 564 and cup 568 with each of the rings having a different slope. In yet other implementations, cover portion 566 may comprise one or more intermediate steps between rim 564 and cup 568. In still other implementations, cover portion 566 may comprise a floor surface extending perpendicular to the axial centerline of bat 20, wherein the floor surface is axially recessed from rim 564 and is connected to rim 564 by a wall that extends parallel to the axial centerline of bat 20.

Cup 568 comprises a core receiving container axially extending from cover portion 566 towards knob 22 of bat 20. Cup 568 comprises a floor 570, outer walls 572 and a mouth 574. Outer walls 572 extend from floor 570 in a direction away from knob 22, terminating at mouth 574. In the example illustrated, outer walls 572 comprise a smaller diameter portion 574 and a larger diameter portion 576. Smaller diameter portion 574 receives and retains a spring of weight retainer 556 a larger diameter portion 576 receives the weight or weights 554.

Mouth 574 faces in a first direction away from knob 22. Floor 570 and larger diameter portion 576 of outer walls 572 of cup 568 define interior cavity 577 configured to receive core 560. Outer walls 572 extend about a centerline of bat 20.

Core 552 comprises a weight receiving component releasably or removably mounted within cup 568. Core 552 comprises a top 578, sidewalls 580 and retainer 582.

Top 578 extends across mouth 574 of cup 568, closing mouth 574. In the example illustrated, top 578 comprises a noncircular opening 584 that facilitates gripping and rotation of core 552 relative to cup 568. Opening 584 further forms a window that facilitates viewing of weights 554 within core 552. Although opening 584 is illustrated as having a plurality of angularly spaced notches circumscribing the centerline of cup 568, in other implementations, opening 584 may have other shapes such as polygon shapes, oval-shapes or the like.

In other implementations, core 552 may include other alternative structures or mechanism to facilitate rotation of core 552. For example, in other implementations, core 552 may alternatively include a projection, such as a knob, similar to knob 84 described above, wherein the projection is configured to be manually gripped or is configured to be engaged by a tool. In other implementations, top 578 may comprise other mechanisms to facilitate manual gripping or tool assisted gripping and movement of core 552.

Sidewalls 580 axially extend from top 578 towards knob 22 and towards floor 570 of cup 568. Sidewalls 580 extend about the centerline of core 552 and cup 568, terminating at a mouth 586 that faces floor 570 and knob 22, in an axial direction opposite to the direction in which mouth 574 faces. Sidewalls 580 and top 578 form an interior cavity 587 for containing at least one weight 554. Top 578 and floor 570 cooperate to form an enclosed volume for containing the at least one weight 554.

Retainer 582 (schematically illustrated) comprises a structure carried by core 552 that assists in axially securing core 552 in place relative to cup 86, inhibiting inadvertent withdrawal of core 552 from cup 568. In the example illustrated, retainer 582 comprises a set of threads formed on the exterior surfaces of sidewalls 580 which threadably engage interior threads provided on the inner surface of sidewalls 572 of cup 568. In such an implementation, core 552 is screwed into cup 568, releasably securing core 552 in place within cup 568. In another implementation, retainer 582 may comprise a bayonet connector portion that interlocks with a corresponding bayonet connector portion provided in the interior of cup 568. In still other implementations, retainer 582 may comprise other snaps, hooks, clips or other mechanisms that facilitate releasable connection and retention of core 552 within cup 568.

Weights 554 comprise individual discs slidably positionable within cavity 587 of core 552. In one implementation, each of weights 554 has a same size and a same weight. In other implementations, at least some of weights 554 may have different sizes and/or different weights, wherein the different weights are cheap due to the different material composition and/or different shape or size of the individual weights 554. Weights 554 have major faces that stack and abut against one another within cavity 587. In one implementation, each of weights 554 has an indicia on a main face indicating its weight, wherein the indicia of the topmost weight in contact with top 578 is viewable through opening 584. Although FIG. 12 illustrates a single weight 554 within cavity 587, it should be appreciated that multiple other weights 554 that have the same outer diameter, what but with the same or different thickness and with the same or different weights may be stacked within cavity 587.

Weight retainer 556 comprises a mechanism that axially secures weights 554 in place relative to core 552 and cup 568. In the example illustrated, weight retainer 556 comprises platform 590 and spring 592. Platform 590 underlies the one or more weights 554 which are captured between platform 590 and top 578. Platform 590 is slidably guided within core 552 by sidewalls 580 of core 552.

Spring 592 comprises a compression spring captured between floor 70 and platform 590. In the example illustrated, spring 592 is retained in place by lower portion 574 of sidewalls 572 of cup 568. Spring 590 to resiliently urge is platform 590 towards top 578 so as to urge or press weights 554 against top 578. Because opening 584 is shaped differently and/or sized smaller than the shape and/or outer diameter of the disc forming weights 554, weights 554 captured between platform 590 and top 578. In other implementations, spring 592 may alternatively comprise a leaf spring.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. An end cap assembly for a bat, the endcap assembly comprising:

a body to be mounted across an open end of a barrel of the bat, the body comprising a cup having outer walls extending about a first interior cavity and forming a first mouth facing in a first direction, the outer walls extending about a centerline of the bat and radially spaced from interior sides of the barrel of the bat by an unfilled void of at least 0.3 inch;

a core received within the cup adjacent the outer walls such that the unfilled void is sandwiched between the core and the interior sides of the barrel, the core comprising: a retainer to releasably and axially retain the core within the cup.

2. The endcap assembly of claim 1, wherein the core further comprises a second interior cavity with a second mouth facing in a second direction opposite the first direction, and wherein the second interior cavity receives a weight through the second mouth.

3. The endcap assembly of claim 1 further comprising a first bayonet connector portion along the first interior cavity and wherein the retainer comprises a second bayonet connector portion interlocked with the first bayonet connector portion.

4. The endcap assembly of claim 3 further comprising a spring within the cup and resiliently biasing the core away from a floor of the cup.

5. The endcap assembly of claim 3, wherein the first bayonet connector portion comprises an inwardly extending projection and wherein the second bayonet connector comprises a U-shaped slot receiving the inwardly extending projection.

6. The endcap assembly of claim 5, wherein the U-shaped slot is shaped such that an interior of the U-shape faces away from the open end of the barrel of the bat when the endcap assembly is received within the bat.

7. The endcap assembly of claim 5 comprising an insert within the cup, the insert providing the inwardly extending projection.

8. The endcap assembly of claim 5, wherein the core comprises:

a sleeve having a hollow interior, a closed-end and sides, wherein the U-shaped slot extends in the sides; and a weight plug received within the hollow interior, the weight plug contacting the spring supported within the cup.

9. The endcap assembly of claim 8 further comprising a second core interchangeable with the first core, the second core comprising:

a second sleeve having a second hollow interior, a second closed-end and second sides in which a second U-shaped slot extends, the second U-shaped slot to receive the inner projection; and a second weight plug received within the second hollow interior, the second weight plug have a different weight than the first weight plug, the second weight plug to contact the spring when the second core is interchanged with the first core.

10. The endcap assembly of claim 5, wherein the body further comprises: barrel retainers to contact the interior sides of the barrel; and a cover portion extending from the barrel retainers to the cup.

11. The endcap assembly of claim 10, wherein the body comprises a rim configured to extend across an axial end of the barrel and wherein cup and the received core are recessed from the rim so as to be recessed from an axial end of the barrel when the endcap assembly is received within the bat.

12. The endcap assembly of claim 10, wherein the cup has a mouth and wherein the cover portion extends from the rim to the mouth.

13. An end cap assembly for a bat, the endcap assembly comprising: a body to be mounted across the end of a barrel of the bat, the body comprising: a barrel retainer to contact the interior sides of the barrel; a rim extending from the barrel retainer so as to extend across an axial end of the barrel when the endcap assembly is positioned within the barrel; a cup having a mouth axially recessed from the rim, a core received within the cup, the core having a mouth to face away from the axial end of the barrel when endcap assembly is positioned within the barrel, the core comprising: a sleeve having a hollow interior, a closed-end and sides; and a weight plug, received within the hollow interior; and a spring in direct contact with the weight plug resiliently biasing the weight plug towards the closed end of the sleeve and towards the axial end of the barrel when the endcap assembly is positioned within the barrel.

14. The end cap assembly of claim 13, wherein the cup has interior sides supporting a first bayonet connector portion, the end cap assembly further comprising a core in which the weight is received within the cup and in which the weight is received, the core supporting a second bayonet connector portion interlocked with the first bayonet connector portion.

15. The endcap assembly of claim 14, wherein the first bayonet connector portion comprises an inwardly extending projection and wherein the second bayonet connector comprises a U-shaped slot receiving the inwardly extending projection.

16. The endcap assembly of claim 15, wherein the U-shaped slot is shaped so as to face away from the end of the barrel of the bat when the endcap assembly is received within the bat.

17. The endcap assembly of claim 15 comprising an insert within the cup, the insert providing the inner projection.

18. The endcap assembly of claim 13 further comprising a cover portion extending from the rim to the cup.

19. The endcap assembly of claim 13 further comprising a second core interchangeable with the first core, the second core comprising:

a second sleeve having a second hollow interior, a second closed-end and second sides; and a second weight plug received within the second hollow interior, the second weight plug having a different weight than the first weight plug.

20. An end cap assembly for a bat, the endcap assembly comprising:

a body to be mounted across the end of a barrel of the bat, the body comprising: a barrel retainer to contact the interior sides of the barrel;

a rim extending from the barrel retainer so as to extend across an axial end of the barrel when the endcap assembly is positioned within the barrel; and a cup having a mouth axially recessed from the rim the cup to receive a weight;

a core received within the cup, the core having a cavity with a cavity mouth facing the mouth of the cup;

a plurality of incremental weights removably received within the cavity; and a retainer axially securing each of the weights in place within the cavity, wherein the retainer comprises:

a spring, wherein the incremental weights are in a stack sandwiched between the spring and the core and wherein the spring resiliently urges the stack against the core.

21. The endcap assembly of claim 20, wherein the sleeve comprises a window through which a face of one of incremental weights is viewable from outside of the endcap assembly.

22. The endcap assembly of claim 13, wherein the body comprises a barrel retainer to engage interior sides of the barrel and wherein the cup is radially spaced from the barrel retainer by at least 0.3 inch by an unfilled void.

23. The endcap assembly of claim 1, wherein body comprises a rim extending across the end of the barrel and wherein the first mouth is axially recessed from the rim.

24. The endcap assembly of claim 23, wherein the first mouth is axially recessed from the rim by at least 0.1 inch.

* * * * *